United States Patent [19]

Bergthaller et al.

[11] 4,383,021

[45] May 10, 1983

[54] IMAGE-RECEIVING ELEMENT FOR THE DYE DIFFUSION TRANSFER PROCESS WITH METAL COMPLEX OF DIAZABICYCLOOCTANE

[75] Inventors: Peter Bergthaller, Cologne; Guenter Helling, Odenthal; Jürgen Strauss, Cologne, all of Fed. Rep. of Germany

[73] Assignee: Agfa-Gevaert Aktiengesellschaft, Leverkusen, Fed. Rep. of Germany

[21] Appl. No.: 347,510

[22] Filed: Feb. 10, 1982

[30] Foreign Application Priority Data

Feb. 17, 1981 [DE] Fed. Rep. of Germany ..... 3105777

[51] Int. Cl.[3] ..... G03C 1/40; G03C 5/54; G03C 1/10

[52] U.S. Cl. ..... 430/213; 430/941; 544/225; 544/226; 544/351

[58] Field of Search ..... 430/213, 216, 941; 101/464; 8/467; 544/351, 349, 225, 226

[56] References Cited

U.S. PATENT DOCUMENTS

| | | | |
|---|---|---|---|
| 3,396,127 | 8/1968 | Burness et al. | 544/351 |
| 3,941,598 | 3/1976 | Van Goethem et al. | 544/351 |
| 4,092,316 | 5/1978 | Nieh | 544/351 |
| 4,273,853 | 6/1981 | Ponticello et al. | 430/213 |

OTHER PUBLICATIONS

Hawks et al, *Research Disclosure* No. 18534, 9/1979, pp. 505–512.

*Primary Examiner*—Richard L. Schilling
*Attorney, Agent, or Firm*—Connolly and Hutz

[57] ABSTRACT

Nickel complexes of diazabicyclooctane derivatives of one of the following formulae I and II are useful metallizing agents for the formation of metal complexed image dyes in image receiving elements for the dye diffusion transfer process (I) (II)

In these formulae $R^1$ represents an n-functional aliphatic hydrocarbon radical optionally containing carbocyclic or heterocyclic groups, carbonyl groups, sulphonyl groups and/or heteroatoms (O, S, N) as intermediate members;

$R^2$ and $R^3$ represent hydrogen or alkyl;

$A^\ominus$ represents an anion; and n represents a number of from 1 to 5.

2 Claims, 1 Drawing Figure

IMAGE-RECEIVING ELEMENT FOR THE DYE DIFFUSION TRANSFER PROCESS WITH METAL COMPLEX OF DIAZABICYCLOOCTANE

This invention relates to an image receiving element for the production of color photographic images by the dye-diffusion transfer process in which post-metallizable diffusible dyes are used for producing the dye image. According to the present invention, the metallizing agents used are nickel complexes of diazabicyclooctane derivatives and partially quaternized reaction products thereof with alkylating agents, said nickel complexes being contained in the image-receiving layer.

The use of polyvalent, particularly complexing metal cations is of particular interest in image-receiving layers for the photographic dye-diffusion transfer process. It is known that a photosensitive recording material comprising several silver halide emulsion layers of different spectral sensitivity and color-providing compounds associated therewith may be used in the dye-diffusion transfer process which is particularly important for the so-called color instant photography. The color providing compounds used are, for example, so-called dye developers which are initially diffusible compounds containing a chromophoric residue and a developer function by which the compounds are immobilized image-wise during development, or non-diffusing color-providing compounds or so-called dye releasers which contain a chromophoric residue which is released image-wise during development in the form of a diffusible dye or dye precursor. Where the chromophoric residue of the dye developers or of the dye releasers contains particularly substituents (chelatable groups) which are suitable as ligands for complexing with polyvalent metal cations, it is possible to utilise complexation for improving light stability, for influencing color tone and for fixing the image dyes transferred to the image-receiving layer. Complexation is preferably carried out after transfer of the dyes, for which purpose either the image-receiving material is treated with a solution of the complexing polyvalent metal cations, for example in the form of a solution of the corresponding salts, or alternatively the polyvalent metal cations are incorporated in one or more layers of the image-receiving material so that they are able to react immediately with the dyes diffusing into the image-receiving layers during the development process to form complexes.

Polymers containing polyvalent metal cations bound in complex form and the use thereof in image-receiving layers of color photographic materials for the dye diffusion transfer process are described in Research Disclosure No. 18534 (September 1979). However, the uptake capacity of the polymers mentioned therein for polyvalent metal cations is limited.

It is known from EP-A 0 009 411 that the cationic nickel or copper complexes of polyvinyl pyridine or polyvinyl imidazole may be used as metallizing agents for postcomplexable image dyes. Although the complexes in question have very little color of their own at a neutral pH, they rapidly take on a reddish-yellow color at the pH of an alkaline processing medium and only lose that color very slowly (generally over a period of days), spoiling the image in the meantime. In addition, the proportion of coordinated heteroaromatically-bound N atoms which remains attached to the dye/metal complex adversely affects the nuance of the image tone, particularly in the case of cyan dye complexes. In most cases, there is an undesirable slight shift of the absorption band by which the color tone is shifted towards blue.

It is also known from the above-mentioned European Patent Application that metal complexes of polymers containing iminodiacetic acid units may be used as metallizing agents. These metallizing agents can be cationically adjusted only when optimal stoichiometry is given and, for this reason, require additional cationic centres in the skeleton of the polymer to retain the anionic image dye. The system is thus made difficult to handle in terms of polymer chemistry and becomes susceptible to agglomeration, particularly in the case of latex polymers.

An object of the present invention is to provide a metallizing agent which may be particularly easily introduced into a layer of the image-receiving element for color photographic images by the dye diffusion transfer process, which retains metal ions, particularly nickel (II) or zinc, in non-diffusing form, is itself cationic in character and, accordingly, does not react with a cationic mordant and which does not have disadvantages as far as the image formed is concerned, above all no color of its own. It has now been found that metallizing agents which satisfy the above requirements may be particularly easily obtained by reacting diazabicyclooctanes or quaternization products thereof still containing free (non-quaternized) tertiary amino groups with nickel (II) ions or zinc ions.

SUMMARY OF THE INVENTION

The present invention relates to an image-receiving element for the dye diffusion process consisting of a layer arranged on a layer support which layer is capable of being dyed by diffusible anionic image dyes and which contains metallizing agents for complexible dyes, in which the dyeable layer contains nickel complexes or zinc complexes of compounds corresponding to one of the following general formulae I and II:

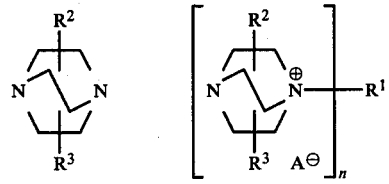

(I) (II)

wherein $R^1$ represents an n-functional aliphatic hydrocarbon radical optionally containing one or a plurality of intermediate members selected from the group consisting of carbocyclic and heterocyclic groups, carbonyl groups, sulfonyl groups and heteroatoms (O, S, N) as intermediate members;

$R^2$ and $R^3$ represent hydrogen or alkyl;

$A^{\ominus}$ represents an anion; and n represents an integer of from 1 to 5.

DETAILED DESCRIPTION OF THE INVENTION

Figure 1:
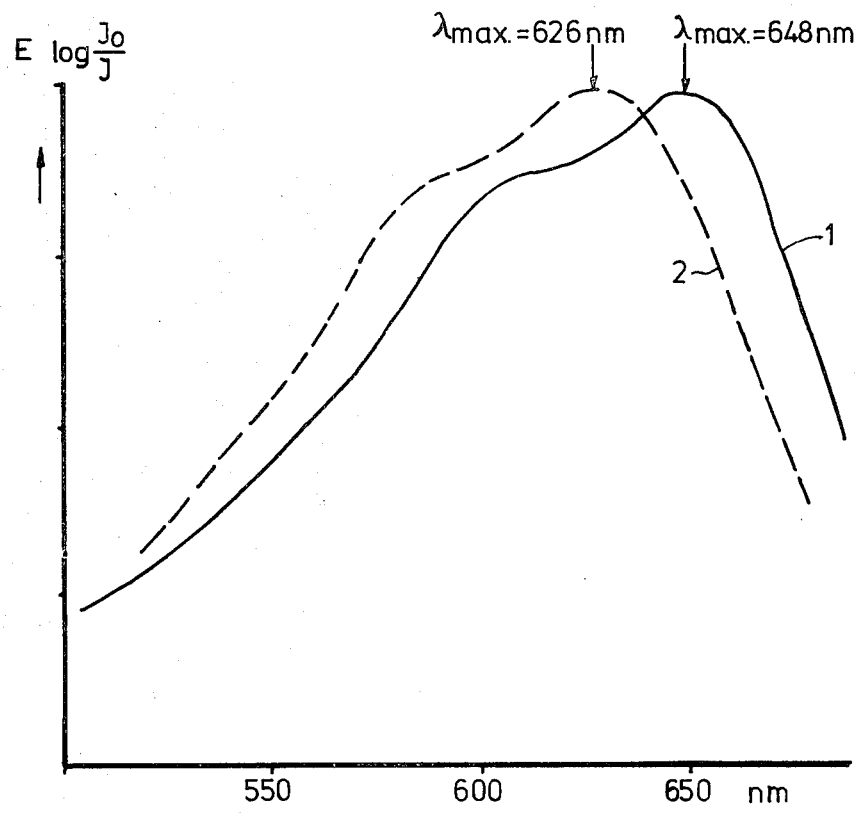

The carbocyclic groups present as intermediate members in the aliphatic hydrocarbon radical represented by $R^1$ may be aromatic groups, for example benzene rings, or cycloaliphatic groups, for example cyclopentane or or cyclohexane rings. Examples of heterocyclic groups are, in particular, diazine rings, for example, piperazine, triazine rings, for example hexahydro-s-triazine, or diazabicycloalkane rings, for example bi-quaternized diazabicyclo[2,2,2]octane.

The aliphatic portion of the radical represented by $R^1$ and the carbocyclic and heterocyclic groups present therein as intermediate members may be substituted for example by alkyl, particularly methyl, or alkoxy, such as methoxy. The N atoms present in the radical $R^1$ carry a hydrogen atom as the third substituent or are substituted by alkyl or acyl, the acyl radical being derived in particular from aliphatic carboxylic acids. The N atoms present as intermediate members may thus be present in the form of amine or amide (imide), at least two of the radicals directly attached to the same N atoms being other than hydrogen. The N atoms may even be present in quaternized form.

When n is not smaller than 3, $R^1$ has branching sites through which further alkylating functions are attached, for example to a C atom in the aliphatic portion of $R^1$ or to an N atom present as an intermediate member or to a cyclic group present as an intermediate member.

The alkyl radicals represented by $R^2$ and $R^3$ contain in particular up to 3 carbon atoms.

The anion represented by $A^{\ominus}$ is inorganic or organic in character and may be present in the form of an independent anion or even in the form of an anionic group attached to an organic radical, for example to a polymer skeleton. In the case of polyfunctional anions, $A^{\ominus}$ represents the equivalent fraction off an anion which is required for the electroneutralization of the positive ammonium group.

The diazabicyclooctane used as starting material for the metallizing agents according to the present invention may be substituted. Diazabicyclo-octanes of this type may be produced by reacting the correspondingly substituted piperazines with 1,2-alkylene bromides. In this connection, reference may be made to:

1. Belova, Davidenkov and Medved, Khimiya i Tekhnol. Poliurethanov 1977, 51–58
2. US-A 4,092,316
3. Jakhontov Mrachkovskaja, Khim. Geterotsikl. Soedin. 1976, (6) 723–738.

Unsubstituted diazabicyclo[2,2,2]octane ("DABCO") is particularly suitable.

The quaternizing agent used for quaternizing the diazabicyclooctane contains up to 5 alkylating groups and may optionally perform a ballast function by virtue of the molecular size thereof or by the presence of relatively long-chain hydrocarbon radicals as substituents.

If partially quaternized metallizing agents are to be used at all, the reaction products of diazabicyclooctanes with bifunctional quaternizing agents are preferred for the purposes of the present invention. Where these reaction products are used, the reaction with nickel ions gives entirely cationic polymer complex chains which, by virtue of the higher coordination number of the nickel ion, are cross-linked via the nickel ions and accordingly, are insoluble in aqueous and organic media. Depending on the selected molar ratio between diazabicyclooctane and alkylating agent, the products obtained contain non-complexing bis-quaternary salt units in the chian and may be represented by formula II wherein n represents 2 and $R^1$ represents a radical corresponding to the following general formula III:

(III)

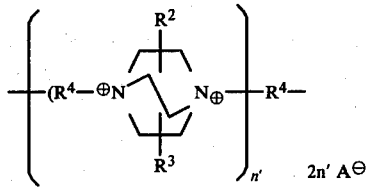

wherein $R^2$ and $R^3$ represent hydrogen or alkyl;

$R^4$ represents $—R^5(—Z—R^5)_{n''}—$;

$R^5$ represents $C_1$–$C_6$ alkylene;

Z represents an intermediate member consisting of one of the following difunctional groups or of a combination of several such groups: —O—, —CO—, $—SO_2—$, —NR— (R represents H or alkyl), alkylene containing from 1 to 6 carbon atoms, arylene and

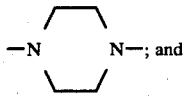

$A^{\ominus}$ represents an anion;

n' represents a number of from 0 to 4; and n'' represents 0 or 1.

To ensure that a balanced ratio is obtained between the metal ions available for complexation and the cationic groups (mordanting), the index n' is preferably limited to values below 4. In other words, the molar ratio of diazabicyclooctane to bifunctional alkylating agent should not fall below a value of 1.2.

In one particular embodiment of the present invention, salts of unsubstituted diazabicyclo[2,2,2]octane with polymeric carboxylic acids, preferably in the form of water-soluble homopolymers or copolymers of acrylic acid, methacrylic acid, crotonic acid, fumaric acid, maleic acid, itaconic acid, are used as nickel-binding and nickel-releasing constituents of the image-receiving layer. In another particular embodiment of the present invention, salts of the unsubstituted diazabicyclooctane with so-called cross-linked latices containing carboxyl groups are used as a constituent of the system which is capable of reversibly binding nickel. As far as the cross-linked latices containing carboxyl groups are concerned, reference may be made to DE-A No. 30 02 287.

One particular advantage of the present invention lies in the fact that the metallizing agents according to the present invention are formed in the image-receiving element itself when the individual components of the image-receiving element are brought into contact with one another. This is preferably done at the casting stage.

Thus, it is sufficient, for example, to coat an image-receiving layer containing a cationic mordant and nickel (II) ions or zinc ions with a casting solution containing a diazabicyclooctane corresponding to general formula I or a compound corresponding to general formula II. Formation of the insoluble complex by diffusion is instanteneous and complete.

The rapid and complete formation of a cationic and insoluble polymeric zinc or nickel complex means that no disadvantages have to be accepted for a photo-sensitive element being in contact with the image receiving element of a color photographic multilayer material.

The nickel complexes used in accordance with the present invention have so little color of their own that the white image areas over those parts of the image-receiving element which do not take up any dye are not in danger of deterioration. The zinc complexes are colorless from the outset.

In any case, the light stability of the mordanted and metallized dye is distinctly improved in relation to comparable image-receiving elements which do not contain the metallizing agents according to the present invention.

Although the metallizing agents according to the present invention do themselves have the effect of a cationic mordant, the optimal effectiveness thereof is only developed in combination with conventional cationic mordants.

Where non-metallized or non-metllizable dyes are used in combination with metallizable dyes, the cationic polyurethanes containing glycidyl groups which are mentioned in DE-A No. 2,631,521 are particularly suitable for use as mordants because, in most cases, they have a favourable effect upon the nuance of the mordanted dyes by steepening the sides of the bands.

The use of diazabicyclooctanes or derivatives thereof as reversibly metal-binding constituents of an image-receiving element is not confined to nickel (II) as the metal ion. Virtually any heavy metal ions or transition metal ions may be bound in this way providing they are not reduced by the diazabicyclooctane derivative. One exception to this is copper(II) which, by reacting with the diazabicyclooctane derivative, is converted more or less rapidly into dark, discolored products of unknown structure. Palladium shows similar behaviour.

The partially quaternized diazabicyclooctane derivatives corresponding to general formula II are produced in known manner by reacting an n-functional alkylating agent $R^1(-X)_n$ (X represents a quaternizing alkylating function) with an excess of diazabicyclooctane. Typical alkylating agents are sulfonic acid esters of monohydric or polyhydric alcohols or of ethyleneoxide-addition products thereof, α-halogen alkane carboxylic acid amides of primary or secondary diamines, triamines or tetramines, chloromethyl derivatives of aromatic compounds, particularly of phenol esters of bifunctional alcohols.

The following are examples of n-functional alkylating agents:

2,2'-dichloro-diethyl ether,
1,4-bis-chloroacetyl piperazine,
1,4,7-tris-chloroacetyl-1,4,7-triazaheptane,
1,4-bis-chloromethyl benzene,
1,2-bis-chloromethyl benzene,
4,4'-bis-chloromethyl-diphenyl ether,
4,4'-bis-chloroacetamino-diphenyl methane,
1,4-bis-chloroacetaminobutane,
1,6-bis-chloroacetaminohexane

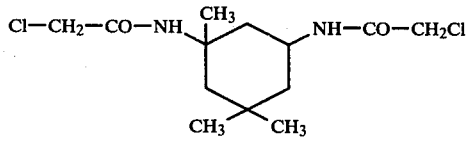

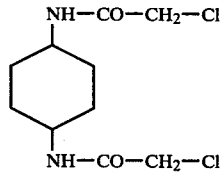

1,4-bis-2-bromopropionyl butane,
triethylene glycol-bis-tosylate,
trimethylol propane-tris-tosylate,
pentaerythritol tetrabromide.

Other typical alkylating agents are the bis- or poly-vinyl sulfone compounds and bis- or poly-acryloyl compounds normally used as hardeners for photographic layers, for example tris-acryloyl hexahydro-s-triazine, bis-vinyl sulfonamide, bis-vinyl sulfonyl methyl ether and also the following compounds:

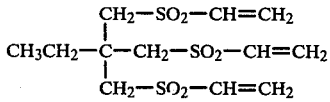

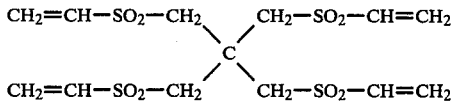

Instead of the unsaturated compounds, it is also possible to use the corresponding sulfates or chlorides, for example

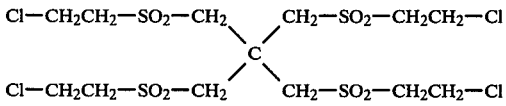

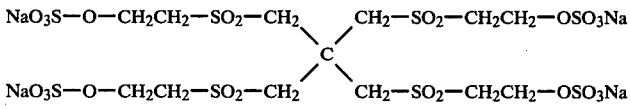

These particular compounds react with the diazabicyclooctane compound in the absence of acid.

The image-receiving elements according to the present invention may be used in the same way in so-called "integral" recording materials where the image-receiving element and the image-producing element are only separated by light-impermeable layers or layer assemblages, and also in image-receiving elements which are only in indirect contact or in temporary contact with the image-producing element and in which case the image dyes have to diffuse, for example through a film of paste or liquid, before they are fixed in the image-receiving layer.

The present invention is illustrated by the following Examples:

EXAMPLE 1

Image-receiving sheet according to the present invention

Two layers are successively applied to a polyethylene-coated paper support (quantities per square meter):

Layer 1: 4 g of a cationic polyurethane according to Example 3 of German DE-A No. 26 31 521, 5 g of gelatin, 1.5 g of nickel acetate and 0.03 g of saponin Layer 2: 1 g of diazabicyclooctane ("DABCO"), 2 g of gelatin and 0.02 g of saponin Layer 3: 0.1 g of gelatin and 0.2 g of an instant hardener of the following structure:

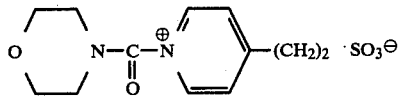

EXAMPLE 2

Image-receiving sheet according to the present invention

Two layers are successively applied to a polyethylene coated paper support (quantities per square meter).

Layer 1: 1 g of diazabicyclo[2,2,2]octane, 2 g of gelatin, 0.015 g of saponin and 0.03 g of tris-acryloyl hexahydro-s-triazine Layer 2: 4 g of the cationic polyurethane according to Example 3 of DE-A No. 26 31 521, 5 g of gelatin, 1.5 g of nickel acetate, 0.06 g of tris-acryloyl hexahydro-triazine and 0.05 g of saponin.

EXAMPLE 3

Image-receiving sheet according to the present invention

The procedure is as in Example 1, except that the layer has the following composition: 1.7 g of a quaternization product which is obtained by reacting diazabicyclo[2,2,2]octane with 2,2'-dichloro-diethyl ether in a molar ratio of 3:2 and which corresponds approximately to the following formula:

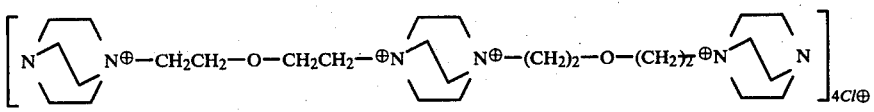

2 g of gelatin, 0.02 g of saponin and 0.1 g of tris-acryloyl hexahydro-s-triazine.

EXAMPLE 4

Comparison material according to EP-A 0 004 911 containing per $m^2$ 5 g of gelatin, 4 g of polyvinyl imidazole, 1.5 g of nickel acetate, 0.04 g of saponin and 0.05 g of tris-acryloyl hexahydro-s-triazine.

EXAMPLE 5

Image-receiving layer according to the present invention

A two-layer image-receiving sheet having the following composition is produced similarly as described in Example 1 (quantities per square meter):

Layer 1: 4 g of the cationic polyurethane according to Example 3 of DE-A No. 26 31 521, 5 g of gelatin and 1.2 g of zinc acetate.

Layer 2: 1 g of diazabicyclo[2,2,0]octane, 2 g of gelatin 0.02 g of saponin.

Layer 3: 0.1 g of gelatin and 0.25 g of the following instant hardener:

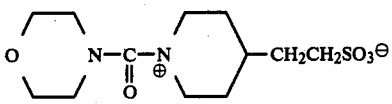

APPLICATION EXAMPLE 1

One strip of each of the image-receiving sheets according to Examples 1 to 5 is immersed for 2 minutes in a 4% NaOH solution. Thereafter, the image-receiving sheets of Examples 1 to 3 appear pale beige when viewed in daylight, the image-receiving sheet of Example 4 has assumed a distinct chamois color, while the image-receiving sheet of Example 5 is colorless.

After subsequent treatment in a bath containing a 3% sodium succinate buffer adjusted to pH 6, the image-receiving sheets of Examples 1 to 3 lose the color thereof, while the image-receiving sheet of Example 4 remains brownish in color and is not really suitable for use as an image-receiving sheet.

APPLICATION EXAMPLE 2

One strip of each of the image-receiving sheets according to Examples 1 to 5 is immersed in a 0.2% solution of the following dyes alkalized with 1% of NaOH until a density of 1.5 is reached behind a filter of complementary color:

Dye 1

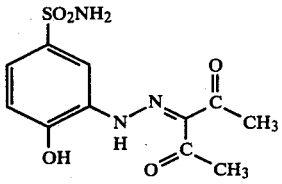

Dye 2

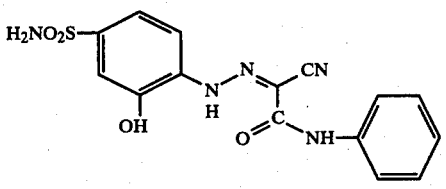

-continued

Dye 3

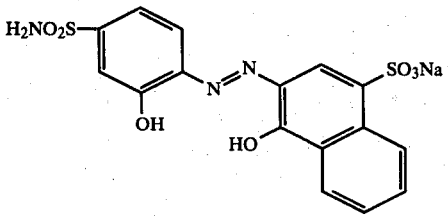

Dye 4

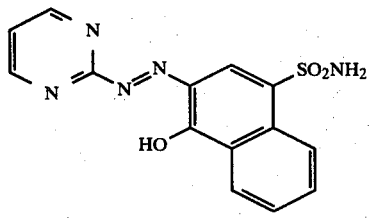

Dye 5

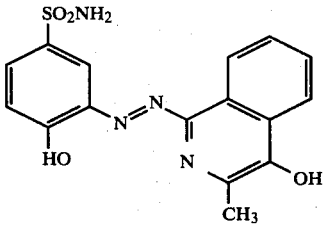

Dye 6

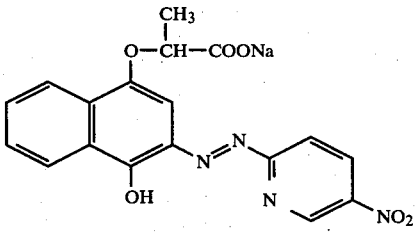

In addition, 6 strips of an image-receiving sheet 6 according to Application Example 2, Variant 2 (Film set D) of DE-A No. 26 31 521 are similarly immersed in solutions of dyes 1 to 6, briefly rinsed with running water and then immersed for 10 seconds in a 3% aqueous nickel acetate solution.

After dyeing all the strips are treated with a 2% sodium succinate solution adjusted to pH 6 and dried.

| Image-receiving sheet | Dyeing with dye number 1 | 2 | 3 | 4 | 5 | 6 |
|---|---|---|---|---|---|---|
| 1 | clear yellow | clear yellow | clear magenta | clear magenta | clear blue tinged with green | dull cyan |
| 2 | clear yellow | clear yellow | clear magenta | clear magenta | clear cyan (FIG. 1, curve 1) | dull blue-gray |
| 3 | clear yellow | clear yellow | clear magenta | clear magenta | clear cyan | dull blue-gray |
| 4 (Comparison) | brown-yellow | dull yellow | dull carmine | dull magenta | dull blue (FIG. 1, curve 2) | very black cyan |
| 5 | particularly clear yellow | particularly clear yellow | clear magenta | clear violet-magenta | clear blue tinged with green | blue tinged with green |
| 6 (Comparison) | clear yellow | clear yellow | clear magenta | clear magenta | clear cyan | dull cyan |

The results show that the clarity of the dye transfers on the image-receiving sheets according to the present invention is in no way inferior to that of dye transfers obtained by subsequent metallization without the incorporation of metal donors. On the other hand, it may be shown (see FIG. 1) that the use of polymeric metal donors corresponding to the prior art as represented by EP-A 0 004 911 not only leads to a general clouding of the dye transfer by the brown-yellow color of the polymeric complex, it also shifts the position of the absorption band of the metallized azo dye towards shorter wavelengths and, hence, complicates the adjustment of an acceptable color tone, for example a cyan tone.

By contrast, the use of polymeric complexes—produced in the layer—of nickel and DABCO or partially quaternized oligomeric DABCO-quaternary salts leads to dye transfers which are not adversely affected by undesirable slight displacements of the main absorption band.

Light Stability Test

Strips containing dye transfers of dyes Nos. 1, 2, 4 and 5 on image-receiving sheets 1, 2, 4 and 6 are subjected to high-intensity exposure using a xenon lamp. The losses of density determined after $4.8\times10^6$ lux hours are shown in the following

| Image receiving sheet | Loss of density with dye number 1 | 2 | 4 | 5 |
|---|---|---|---|---|
| 1 | −2% | −8% | −13% | −42% |
| 2 | −2% | −10% | −10% | −25% |
| 4 | −15% | −10% | −20% | −53% |
| 6 | −47% | −22% | −25% | −36% |

It may be concluded from these results that the light stabilities of the dye transfers may be improved by using the image-receiving layers according to the present invention.

We claim:

1. An image receiving element for the dye diffusion transfer process comprising a dyeable layer on a layer support said dyeable layer being dyeable by diffusible anionic image dyes and containing a metallizing agent for the formation of metal-dye-complexes when said image dyes contain chelatable groups, wherein the improvement comprises said metallizing agent is a nickel complex of a compound of one of the following general formulae I and II

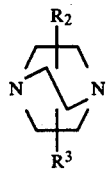

(I)

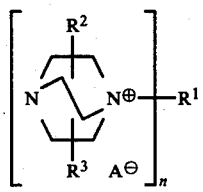

(II)

wherein $R^1$ represents an n-functional aliphatic hydrocarbon radical optionally containing one or a plurality of intermediate members selected from the group consisting of carbocyclic groups, heterocyclic groups, carbonyl groups, sulfonyl groups and oxygen, sulfur and nitrogen heteroatoms;

$R^2$ and $R^3$ represent hydrogen or alkyl;

$A^{\ominus}$ represents an anion; and n represents a number of from 1 to 5.

2. An image-receiving element as claimed in claim 1, wherein in general formula (II) n represents 2 and $R^1$ represents a bivalent radical corresponding to the following general formula (III)

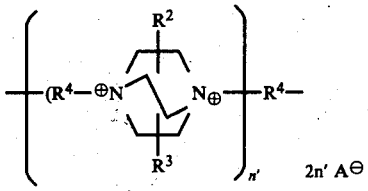

wherein $R^2$ and $R^3$ represent hydrogen or alkyl;

$R^4$ represents $—R^5(—Z—R^5)_{n''}—$;

$R^5$ represents $C_1$–$C_6$ alkylene;

Z represents an intermediate member consisting of one of the following bifunctional groups or of a combination of several such groups: —O—, —CO—, $—SO_2—$, —NR— (R represents H or alkyl), $C_1$–$C_6$ alkylene, arylene and

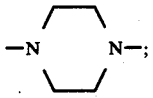

$A^{\ominus}$ represents an anion;

n′ represents a number of from 0 to 4; and n″ represents 0 or 1.

* * * * *